US006309228B2

(12) United States Patent
Otsuki et al.

(10) Patent No.: US 6,309,228 B2
(45) **Date of Patent: *Oct. 30, 2001**

(54) C-SHAPED COMPLIANT CONTACT

(75) Inventors: Tomonari Otsuki; Jinichi Mashiyama; Yoshiaki Takeda, all of Tokyo (JP)

(73) Assignee: DDK Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/767,564

(22) Filed: Jan. 23, 2001

(30) Foreign Application Priority Data

Mar. 9, 2000 (JP) ..... 12-064242

(51) Int. Cl.[7] ..... H01R 12/00
(52) U.S. Cl. ..... 439/84; 439/751
(58) Field of Search ..... 439/82, 84, 751, 439/876

(56) References Cited

U.S. PATENT DOCUMENTS 4,936,797 * 6/1990 Wehrle et al. ..... 439/751
5,667,412 * 9/1997 Takahashi et al. ..... 439/751
5,738,550 * 4/1998 Sakuraoka et al. ..... 439/751

FOREIGN PATENT DOCUMENTS

3633013-A1 * 4/1988 (DE) ..... 439/82

* cited by examiner

*Primary Examiner*—Tho D. Ta
(74) *Attorney, Agent, or Firm*—Baker Botts, L.L.P.

(57) ABSTRACT

A C-shaped compliant contact is composed of a connection portion to be connected to an electric cable or the like, a press-fitting portion to be press-fitted in a through-hole of the printed circuit board, and a contact portion to contact a contact of a mating connector. The press-fitting portion has an inner periphery forming a U-shaped groove in section and an outer periphery forming at least one arc portion. The circle inscribing the inner periphery of the U-shaped groove is in an eccentric relation to the arc portion of the outer periphery. The thickness of the arc portion in cross-section progressively decreasing on proceeding toward the open end of the U-shaped groove to make longer the arc portion contacting the through-hole of the printed circuit board. The U-shaped groove is formed with a ramp surface located inside the inner periphery near to the connection portion, connected to the bottom of the U-shaped groove and inclined to make shallower the U-shaped groove, thereby preventing the connection portion of the contact from being bent when it is being press-fitted into the through-hole of the printed circuit board.

4 Claims, 7 Drawing Sheets

C-SHAPED COMPLIANT CONTACT

BACKGROUND OF THE INVENTION

This invention relates to a C-shaped compliant contact composed of a connection portion adapted to be connected to an electric cable or the like, a press-fitting portion adapted to be press-fitted in a through-hole of a printed circuit board, and a contact portion adapted to be in contact with a contact of a mating connector, and more particularly to a C-shaped compliant contact capable of preventing from bending when it is being inserted into a through-hole of a printed circuit board.

A hitherto used C-shaped compliant contact will be explained by referring to FIGS. 5 to 6. FIG. 5 illustrates the press-fitting portion 16 and the connection portion 18 of the C-shaped compliant contact 40 of the prior art in a partly perspective view. FIGS. 6A, 6B and 6C illustrate the C-shaped compliant contact of the prior art in a plan view, a longitudinal sectional view taken along the line A—A in FIG. 5 and a cross-sectional view taken along the line B—B in FIG. 5, respectively. FIG. 7 illustrates the C-shaped compliant contact of the prior art in various states in one drawing from the first step to the last step for press-fitting the contact into a printed circuit board.

In general, the C-shaped compliant contact is made of a springy copper alloy such as phosphor bronze, beryllium copper or the like. It is best to manufacture the C-shaped compliant contact so as to apply uniform stresses onto the inner surface of the through-hole of a printed circuit board in which the press-fitting portion of the contact has been press-fitted.

In order to fulfil such a requirement, the applicant has proposed in Japanese Patent Application Opened No. H8-31,476 a C-shaped compliant contact 40 including a press-fitting portion 16 having an inner periphery forming a U-shaped groove having two arc portions 28 and a straight portion 30 therebetween so that the circle inscribing the U-shaped inner periphery is in an eccentric relation to the two arc portions 28. The thickness of the arc portions 28 become progressively thinner on proceeding toward the open end of the U-shaped groove so as to make longer the length of the arc portions 28 contacting the through-hole 26 of a printed circuit board as much as possible.

With such a proposed C-shaped compliant contact 40, because of the spring-like property of the walls of the U-shaped groove of the press-fitting portion 16 and because of the arc-shaped outer periphery to be press-fitted in the through-hole 26, the press-fitting portion 16 elastically deforms and contacts the through-hole 26 with wide contacting surfaces, thereby achieving a uniform deformation of the printed circuit board 24.

The C-shaped compliant contact 40 of the prior art has the press-fitting portion 16 constructed as described above and the thickness of the arc portions 28 becoming thinner on proceeding toward the ends of the walls of the U-shaped groove. When the contact 40 is being inserted into the through-hole 26 of a printed circuit board 24, the walls of the U-shaped groove are forced toward each other as shown by arrows P and Q in FIG. 5 so as to reduce the size of that portion to facilitate the insertion into the through-hole 26. As a result, a force will act on the inner surface 19 in the groove 22 of the contact 40 in a direction (toward the connection portion 18) as shown by an arrow R in FIG. 6B so that the connection portion 18 will be bent in the direction opposite to the outer surface 17 of the connection portion 18, which is a problem to be solved.

As shown at the lowermost position in FIG. 7, the distal end of the connection portion 18 of the contact 40 is shifted by a distance of the order of 0.8 to 0.85 mm away from the extension D of the outer line of the contact 40 which has press-fitted in the through-hole 26 of the printed circuit board 24.

SUMMARY OF THE INVENTION

It is an object of the invention to provide a C-shaped compliant contact having a press-fitting portion which can be press-fitted in a through-hole of a printed circuit board without being bent at its connection portion adjacent the press-fitting portion.

In order to accomplish this object, in a C-shaped compliant contact composed of a connection portion to be connected to an electric cable, a connector on the rear side of a printed circuit board or the like, a press-fitting portion to be fixed in a cylindrical through-hole of the printed circuit board by press-fitting, and a contact portion to be in contact with a contact of a mating connector, said press-fitting portion formed to have an inner periphery forming a U-shaped groove in cross-section and an outer periphery having at least one arc portion in cross-section, circles inscribing said inner periphery of said U-shaped groove and circumscribing said arc portion of said outer periphery being in an eccentric relation, and the thickness of said arc portion in cross-section progressively decreasing on proceeding toward the open end of the U-shaped groove to make longer said arc portion contacting said through-hole of said printed circuit board, according to the invention said U-shaped groove is formed with a ramp surface located inside said inner periphery near to said connection portion, connected to the bottom of said U-shaped groove and inclined to make shallower said U-shaped groove.

With the C-shaped compliant contact constructed described above, however, it may be supposed that if there are differences or irregularities in diameters of through-holes caused by manufacturing errors or should a press-fitting stress more than a predetermined value be applied, the ends of the walls of the U-shaped groove of the press-fitting portion are forced toward each other in excess of the limit of their elastic deformation with resultant permanent deformation thereof. As a result, the distal ends of the walls of the U-shaped groove would separate from the inner surface of the through-hole to reduce the contacting area, resulting in unstable contact between the contact and the printed circuit board and reduction in holding force therebetween.

To overcome this problem, in a preferred embodiment of the present invention a protrusion projecting from the center of the bottom of the U-shaped groove toward its outside, which has been proposed by the applicant in Japanese Patent Application No. H10-388,374, is provided along substantially the full length of the U-shaped groove to an extent such that the protrusion does not adversely affect the flexibility of the ends of the walls of the U-shaped groove. Such a protrusion located at the bottom of the U-shaped groove of the C-shaped compliant contact effectively serves to prevent the separation of the distal ends of the walls of the U-shaped groove from the inner surface of the through-hole and the reduction in contacting area therebetween, thereby eliminating the unstable contact between the contact and the through-hole and reduction in holding force therebetween.

In another preferred embodiment, the ramp surface is: provided such that grooves on both the sides of the protrusion become progressively shallower with a decrease in size of the press-fitting portion adjacent to the connecting portion for facilitating the insertion into the through-hole.

The connected position of the ramp surface to the inner surface of the U-shaped groove at a location where the walls of the U-shaped groove close together on the side of the connection portion is preferably located between the top of the protrusion and the outer surface of the press-fitting portion of the contact. The nearer the connected position to the outer surface of the press-fitting portion of the contact, the greater will be the strength of the inner surface of the U-shaped groove on which the force tilting it acts, as a result of which the connection portion of the contact is prevented from being bent.

The C-shaped compliant contact constructed as described above according to the invention can bring about the following significant effects.

(1) According to the invention, the press-fitting portion of the C-shaped compliant contact is provided near to the connection portion with the ramp surface connected to the bottom of the U-shaped groove and inclined to make shallower the U-shaped groove, thereby substantially avoiding the bending of the connection portion of the contact when it has been press-fitted in a through-hole of a printed circuit board.

(2) According to the invention, the press-fitting portion of the C-shaped compliant contact is provided with the protrusion projecting from the center of the bottom of the U-shaped groove toward the outside thereof along substantially the full length of the groove, and provided with the ramp surface connected to the bottom of the U-shaped groove and inclined to make shallower the groove. With this construction, it becomes possible to substantially eliminate the bending of the connecting portion of the contact when it has been press-fitted in a through-hole of a printed circuit board and to prevent the separation of the distal ends of the walls of the U-shaped groove from the inner surface of the through-hole and the reduction in contacting area therebetween, thereby eliminating the unstable contact between the contact and the through-hole and reduction in holding force therebetween.

(3) According to the invention, the ramp surface is provided such that grooves on both the sides of the protrusion become progressively shallower with a decrease in size of the press-fitting portion adjacent to the connecting portion for facilitating the insertion into the through-hole, thereby more eliminating the bending of the connection portion of the contact with greater certainty.

(4) According to the invention, the connected position of the ramp surface to the inner surface of the U-shaped groove at a location where the walls of the U-shaped groove close together on the side of the connection portion is located between the top of the protrusion and the outer surface of the press-fitting portion of the contact to reinforce the inner surface above described of the U-shaped groove on the side of the connection portion so that the reinforced inner surface is prevented from being tilted toward the connection portion. As a result, when the contact is being press-fitted in a through-hole, the bending of the connection portion of the contact is more effectively prevented.

(5) With the C-shaped compliant contact according to the invention, when it has been press-fitted in a through-hole of a printed circuit board, it can prevent its connection portion from being bent to an extent such that the distal end of the connection portion is shifted by a distance of as little as 0.1 mm to 0.15 mm away from the extension of the outer line of the contact. In comparison therewith, corresponding values of the prior art C-shaped compliant contacts are within the range of 0.8 mm to 0.85 mm.

(6) As the bending of the connection portion of the C-shaped compliant can be prevented to the extent described in the above item (5) according to the invention, a printed circuit board having C-shaped compliant contacts press-fitted therein can be easily mounted onto an appliance or the like without any inaccurate or erroneous mounting.

(7) According to the invention, the ramp surface makes progressively shallower the grooves on both the sides of the protrusion in the U-shaped groove of the press-fitting portion with a decrease in its size for facilitating the insertion into the through-hole. As a result, the ramp surface can be readily formed and there is less chance of damaging blades of punching dies in forming the C-shaped compliant contact than in producing C-shaped compliant contacts of the prior art.

The invention will be more fully understood by referring to the following detailed specification and claims taken in connection with the appended drawings.

DESCRIPTION OF THE PREFERRED EMBODIMENTS

Figure 1:
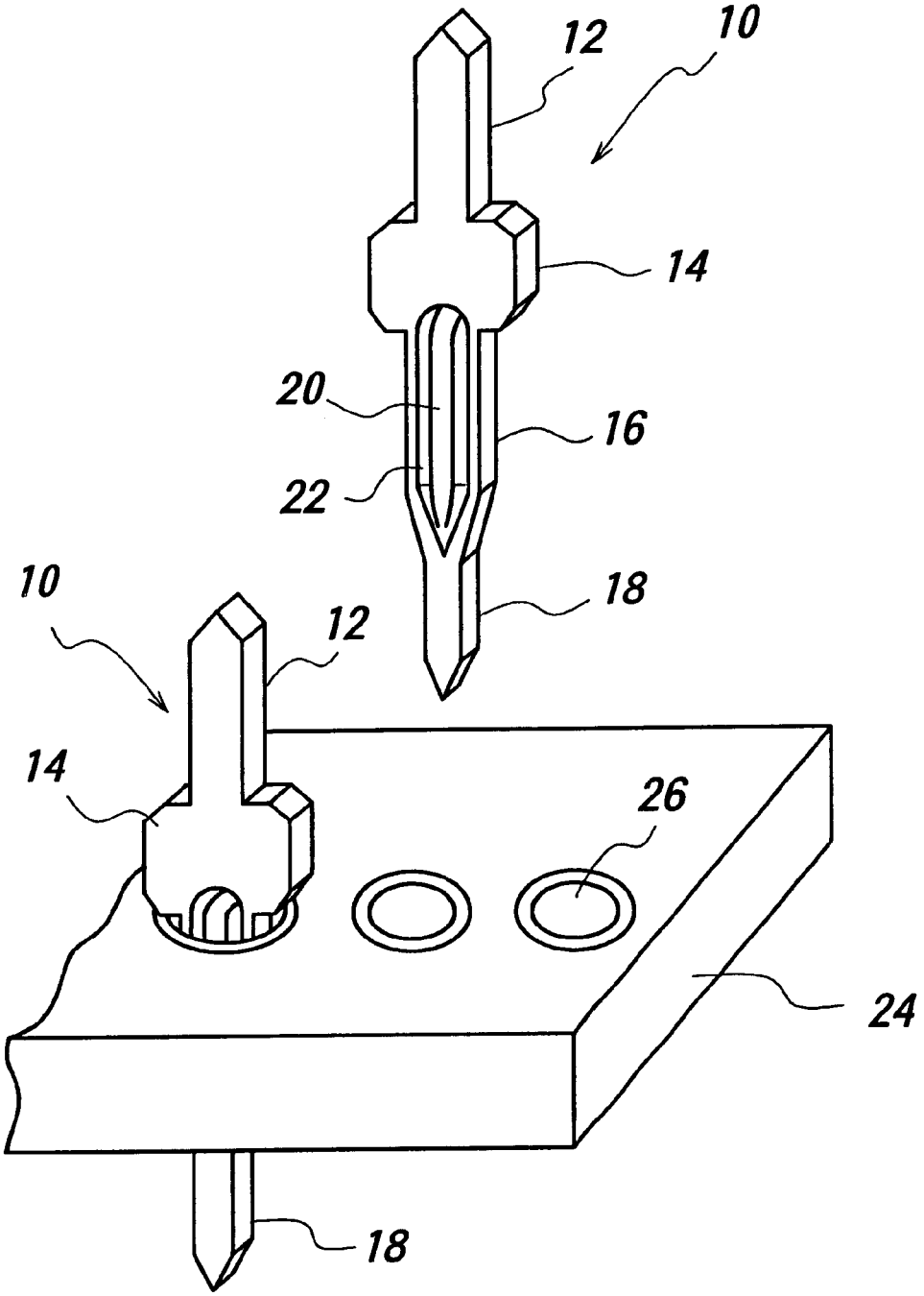
FIG. 1 is a perspective view of a C-shaped compliant contact according to the invention and a C-shaped compliant contact press-fitted in a printed circuit board.

A C-shaped compliant contact 10 of one embodiment according to the invention will be explained hereinafter by referring to FIG. 1.

Preferred materials from which to form the C-shaped compliant contact include springy copper alloys such as phosphor bronze and beryllium copper. The C-shaped compliant contact 10 mainly comprises, usually in that order, a contact portion 12, a press-fitting portion 16 and a connection portion 18. In the shown embodiment, the C-shaped compliant contact 10 is provided with a positioning portion 14 between the contact portion 12 and the press-fitting portion 16.

The constructions and functions of the respective portions of the C-shaped compliant contact 10 according to the invention will be explained in detail hereinafter.

The connection portion 18 of the C-shaped compliant contact 10 serves to connect the C-shaped compliant contact 1 to an electric cable or a connector (not shown) on the rear side of a printed circuit board. In the shown embodiment, the connection portion 18 has a particular cross-section obtained by cutting a circle by two parallel straight lines, that is to say, the cross-section having four sides of which two opposite sides are straight lines parallel to each other and the two remaining sides are arcs. However, other cross-sections may be used, for example, a circular or rectangular cross-section.

The positioning portion 14 of the C-shaped compliant contact 10 includes surfaces adapted to contact a jig (not shown) when the C-shaped compliant contact 10 is being press-fitted into a through-hole 26 of a printed circuit board 24, and surfaces adapted to abut against the surface of the printed circuit board 24 after the contact has been press-fitted in the through-hole 26.

The contact portion 12 of the C-shaped compliant contact 10 is adapted to contact the contact portion of a contact of a mating connector (not shown) when C-shaped compliant contact fitted in the through-hole of the printed circuit board has been connected to the mating connector.

Figure 2A:
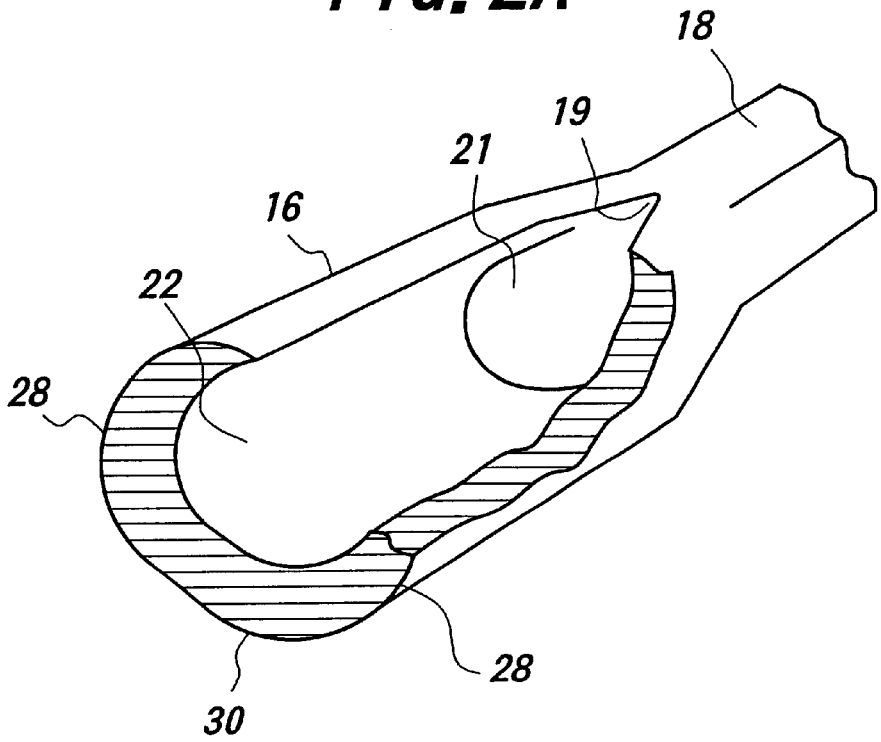
FIG. 2A is a partly perspective view of the press-fitting portion and the connection portion of the C-shaped compliant contact according to the invention.
Figure 2B:
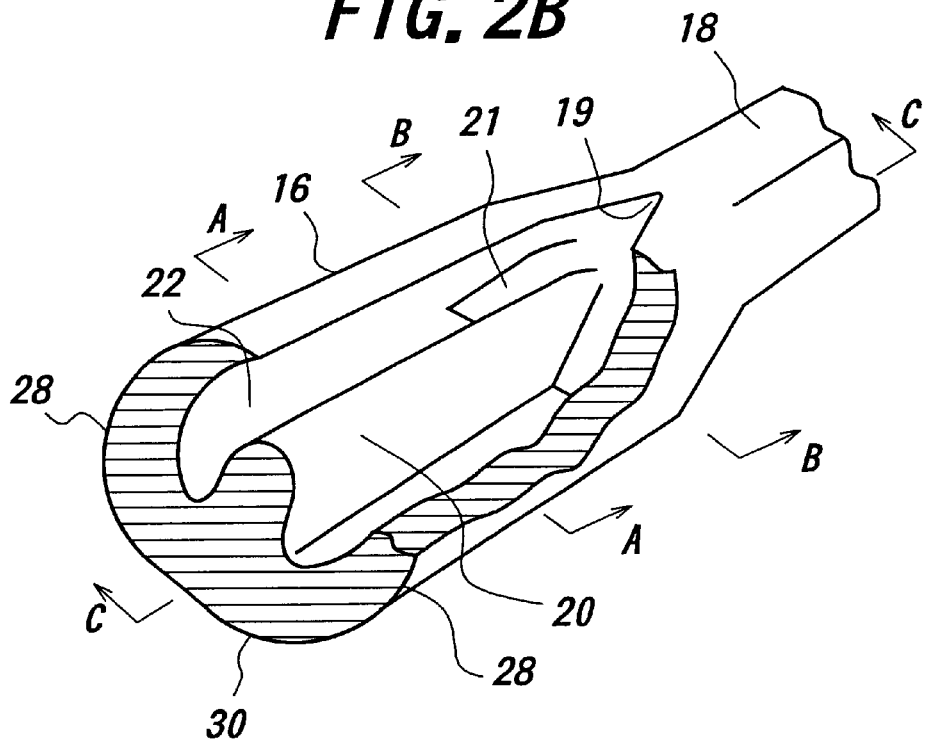
FIG. 2B is a partly perspective view of the press-fitting portion and the connection portion of the C-shaped compliant contact according to another embodiment of the invention.

Finally, the press-fitting portion 16 of the C-shaped compliant contact 10 will be explained, which is a subject feature of the invention. As shown in FIGS. 2A and 2B, the press-fitting portion 16 has a substantially U-shaped cross-section so that its inner periphery is in the form of a U-shaped groove, and in the embodiment shown in FIG. 2B which is provided with a protrusion or ridge 20 at the center of the bottom of the U-shaped groove over its full length so as to project outwardly toward the open end of the U-shaped groove. The outer periphery of the U-shaped groove includes two arc portions 28 and a straight portion 30 therebetween in the conventional manner. The two arc portions 28 are adapted to contact the inner surface of a through-hole of the printed circuit board after the press-fitting portion 16 has been press-fitted therein. The thickness of the press-fitting portion 16 in cross-section becomes progressively thinner on proceeding toward the open end of the U-shaped groove.

The printed circuit board 24 has a thickness of the order of 2.4 mm and its through-holes have a diameter of approximately 0.6 mm. These thickness and diameter may vary depending upon applications of the C-shaped compliant contacts. The dimensions of the press-fitting portion 16 of the C-shaped compliant contact 10 will vary depending upon the thickness of the circuit board and the diameter of the through-hole, so that the dimensions of the press-fitting portion 16 are suitably designed to meet the required conditions.

In order to improve the holding force for the contact 10 and to maintain the force for a long lifetime, the surfaces of the press-fitting portion contacting the inner surface of the through-hole of a printed circuit board are increased as much as possible and the inner periphery of the U-shaped groove is provided with the protrusion or ridge 20 along the center line of the groove to prevent any separation of the surfaces of the press-fitting portion from the inner surface of the through-hole according to the invention.

The protrusion or ridge 20 of the C-shaped compliant contact 10 is formed so as not to decrease the flexibility of the open ends of the U-shaped groove due to its too large size. In the shown embodiment, the protrusion or ridge 20 has a cross-section in the form of a semicircle having a radius substantially equal to one half of the radius of a circle forming the inner periphery of the U-shaped groove and extends over substantially the full length of the U-shaped groove.

The protrusion 20 of the C-shaped compliant contact 10 projects toward the open end of the U-shaped groove from the center line of its bottom, and both the lower edges of the semicircular protrusion 20 at the bottom of the U-shaped groove connect to the bottom with small smooth arc-shaped corners in section. The shape of the groove formed by the inner periphery of the press-fitting portion 16 is preferably in the form of U-shaped groove in view of manufacturing and function of the contact. However, any other shapes of the groove may be used so long as they fulfill the requirements for the function.

Figure 3A:
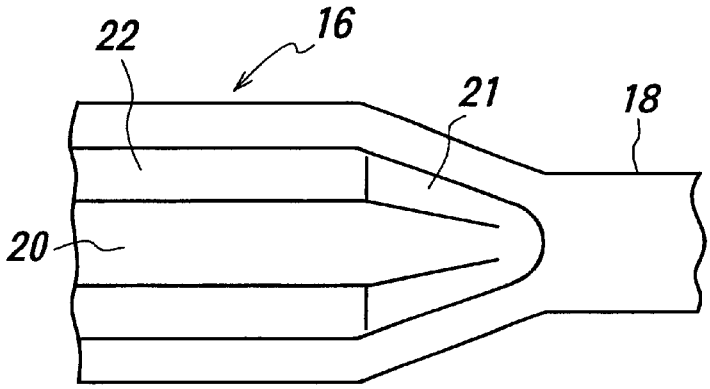
FIG. 3A is a plan view of the contact shown in FIG. 2B.
Figure 3B:
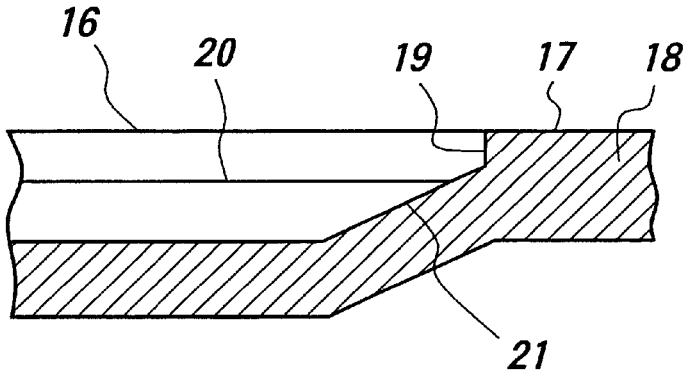
FIG. 3B is a partly longitudinal sectional view of the contact taken along the line C—C in FIG. 2B.
Figure 3C:
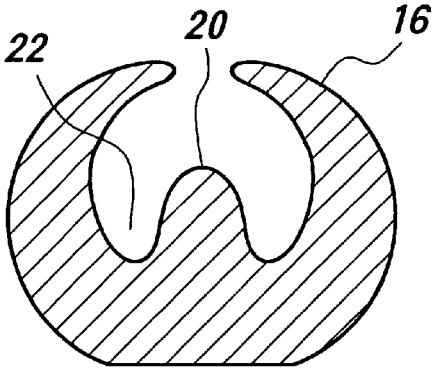
FIG. 3C is a cross-sectional view of the contact taken along the line A—A in FIG. 2B.
Figure 3D:
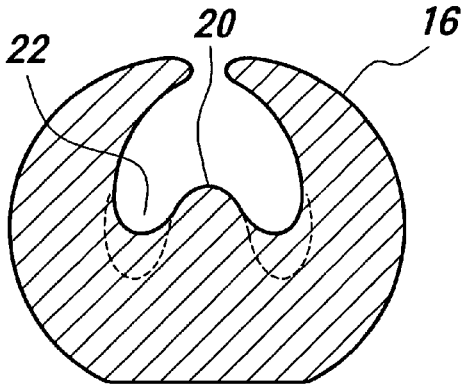
FIG. 3D is a cross-sectional view of the contact taken along the line B—B in FIG. 2B.
Figure 4A:
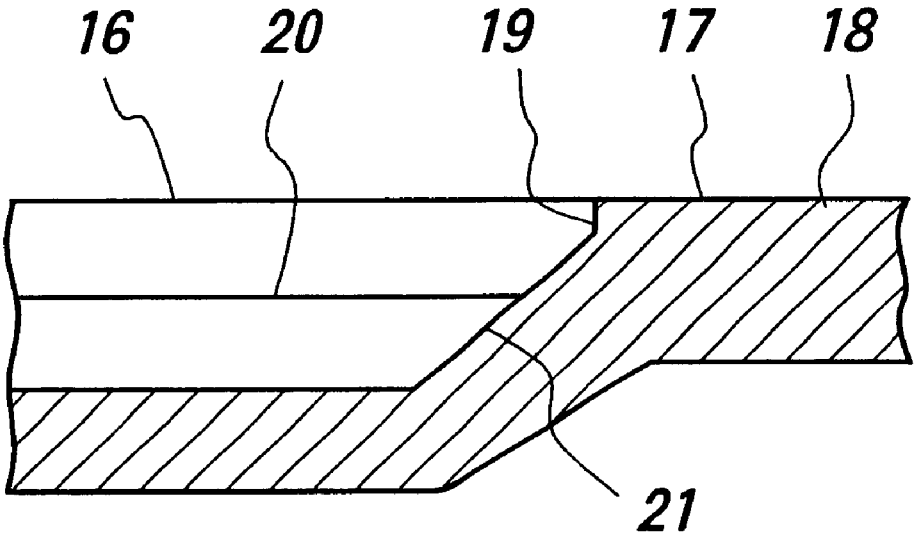
FIG. 4A is a partly longitudinal sectional view illustrating the press-fitting portion and the connection portion of a C-shaped compliant contact according to a further embodiment of the invention.

When the C-shaped compliant contact 10 is being press-fitted into a through-hole 26 of a printed circuit board 24, both the walls of the U-shaped groove of the press-fitting portion 16 are forced toward each other to reduce its outer size in order to facilitate the insertion of the press-fitting portion 6 into the through-hole 26. As a result, a force is generated to cause an inner surface shown by a numeral 19 in FIGS. 2A and 2B to tilt in the press-fitting direction (toward the connection portion 18). As shown in FIGS. 3B and 4A, the inner surface 19 is a narrow surface formed by the fact that the side walls of the U-shaped groove close together at the adjacent end of the connection portion 18.

According to the invention, in the U-shaped groove near to the connection portion 18, there is provided a ramp surface 21 (FIGS. 2A and 2B) connected to the bottom of the U-shaped groove to make it shallower progressively, in order to eliminate the force tilting the inner surface 19. The ramp surface 21 reinforces the inner surface 19 which becomes able to resist to the force tilting it in the press-fitting direction, with the result that the connection portion 18 of the C-shaped compliant contact 10 is prevented from bending when being press-fitted.

In more practically, with the ramp surface 21 (FIG. 2B), the grooves 22 on both sides of the protrusion 20 become progressively shallower on proceeding toward the connection portion 18 as the press-fitting portion 16 becomes narrower. The ramp surface 21 is connected to the bottoms of the grooves 22 and the inner surface 19 with small smooth arc-shaped comers.

Figure 4B:
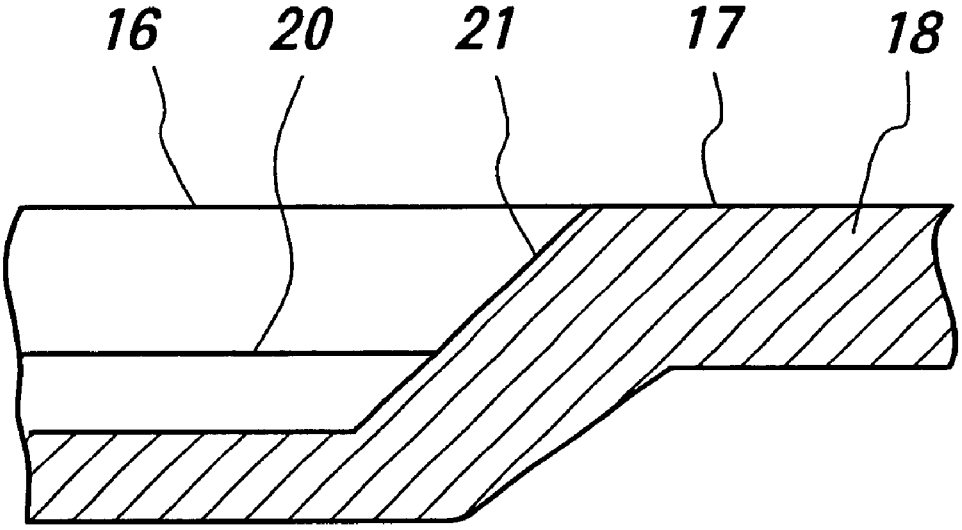
FIG. 4B is a partly longitudinal sectional view illustrating the press-fitting portion and the connection portion of a C-shaped compliant contact according to a still further embodiment of the invention.
Figure 5:
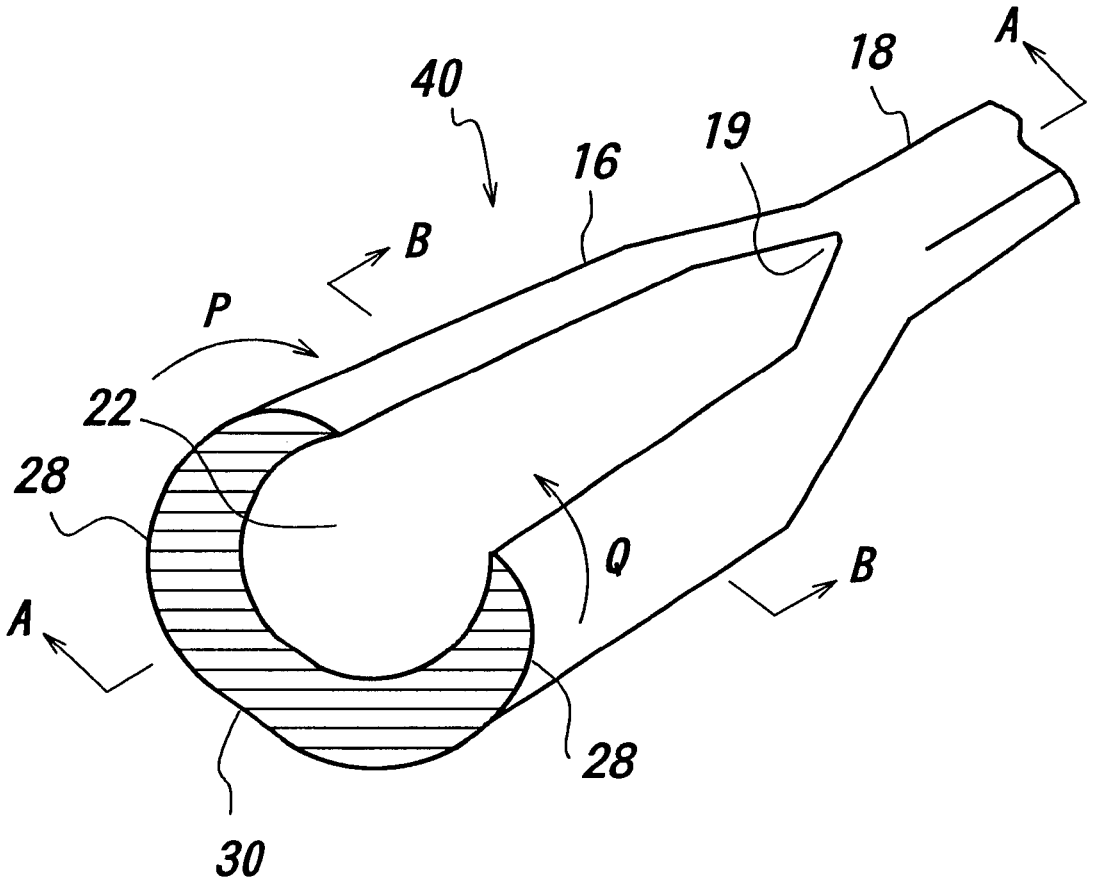
FIG. 5 PRIOR ART
FIG. 5 is a partly perspective view illustrating the press-fitting portion and the connection portion of a C-shaped compliant contact of the prior art.

The connected position of the ramp surface 21 to the surface 19 is preferably located within the area between the top of the protrusion 20 and the upper surface 17 of the contact. If the connected position of the ramp face 21 to the inner surface 19 is located at an inner position than the top of the protrusion 20, it will be impossible to withstand the force tilting the inner surface 19. Therefore, the ramp face 21 may be connected to the inner surface 19 at the position between the top of the protrusion 20 and the upper surface 17 as shown in FIG. 4A, or at the position on the upper surface 17 as shown in FIG. 4B.

The C-shaped compliant contact 10 according to the invention described above is generally manufactured by press-working. The applicant proposed in Japanese Patent Application No. 2000-015570 a novel method for producing a C-shaped compliant contact in order to reduce residual strains in the press-fitting portion caused in its forming processes and to reduce irregularities in the shape of the U-shaped groove in cross-section. The proposed method comprises steps of forming a concave in a rectangular block at its center by forging, removing both the ends of the block by punching and forming the block having a U-shaped cross-section by press-forming such that its outer circumference becomes concentric to the circle of a through-hole of a printed circuit board when it is press-fitted therein.

Figure 6A:
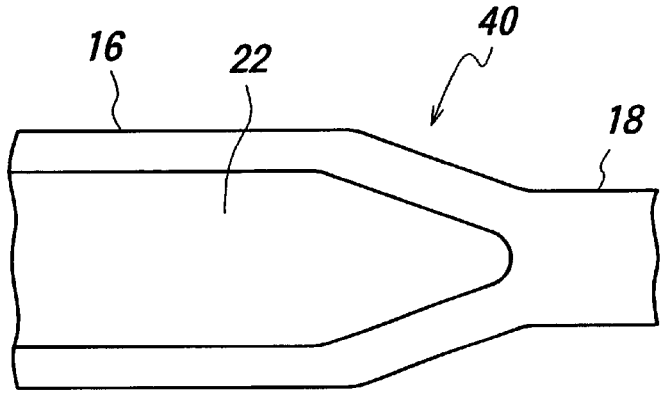
FIG. 6A PRIOR ART
FIG. 6A is a plan view of the contact shown in FIG. 5.
Figure 6B:
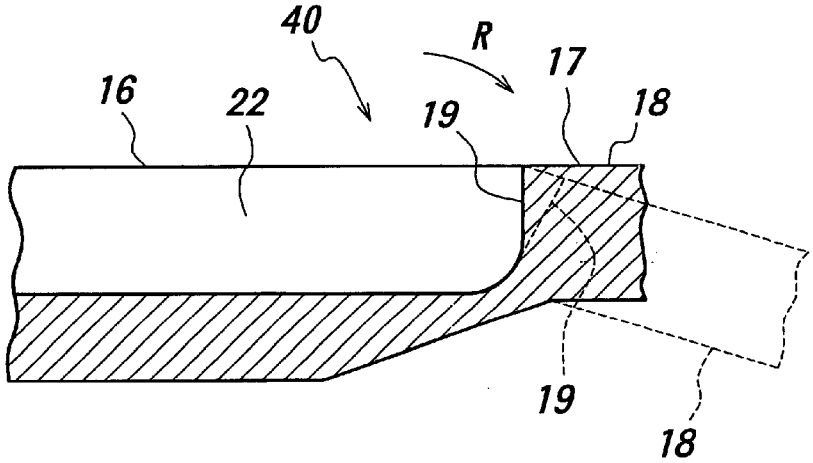
FIG. 6B PRIOR ART
FIG. 6B is a longitudinal sectional view of the contact taken along the line A—A in FIG. 5.
Figure 6C:
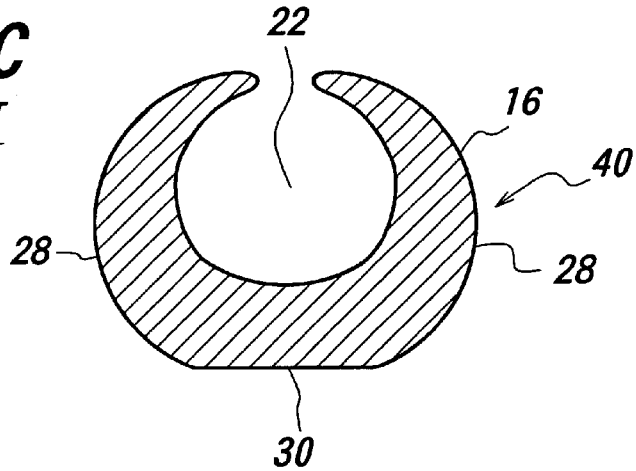
FIG. 6C PRIOR ART
FIG. 6C is a cross-sectional view of the contact taken along the line B—B in FIG. 5.
Figure 7:
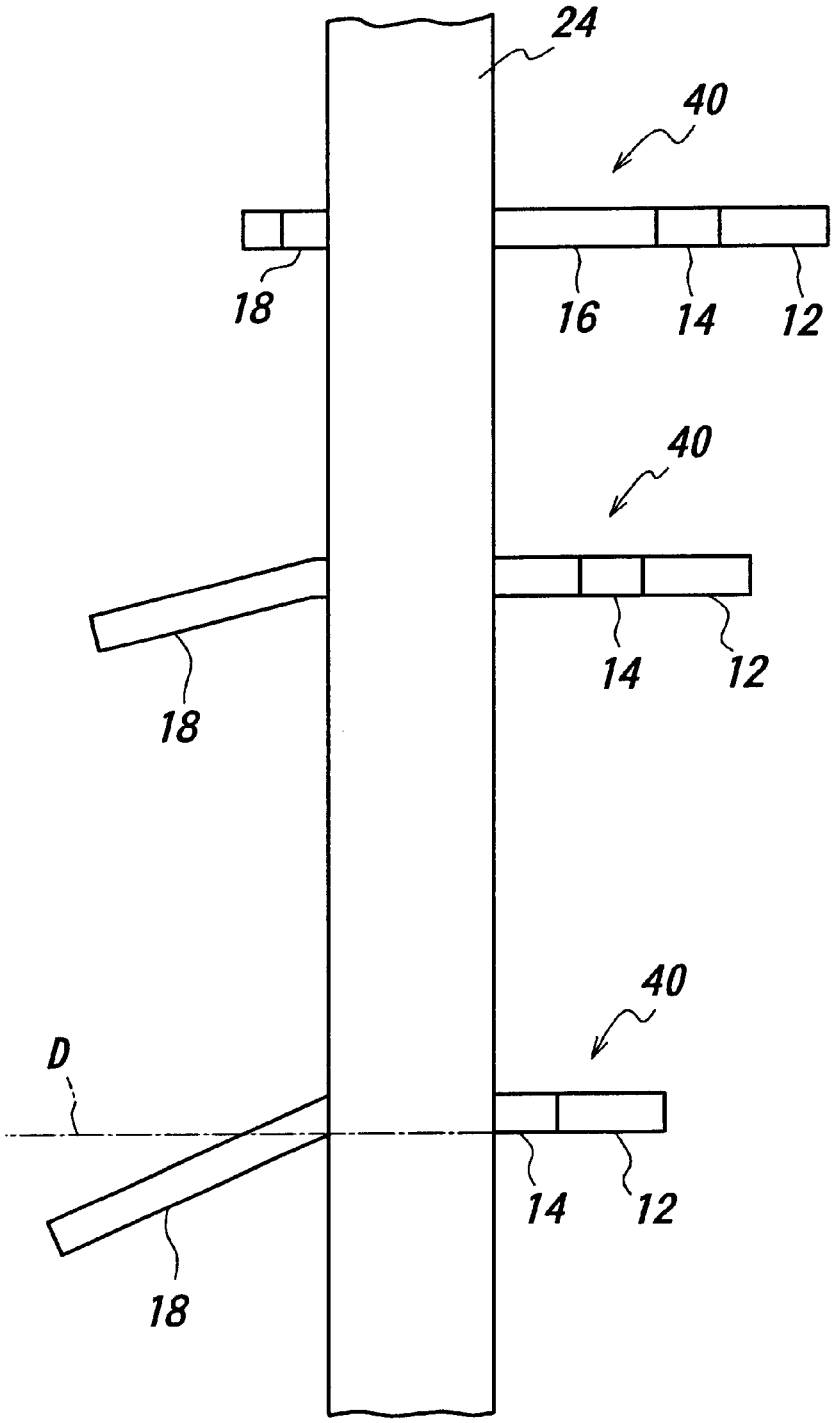
FIG. 7 PRIOR ART
FIG. 7 is a view illustrating three states of the C-shaped compliant contact of the prior art in one drawing from the first step to the last step for press-fitting the contact into a printed circuit board.

According to the present invention, the ramp surface 21 is provided in the U-shaped groove near to the connection portion of a C-shaped compliant contact such that the ramp surface 21 is connected to the bottoms of the grooves 22 so as to make shallower the grooves 22. When the C-shaped compliant contact 10 is being press-fitted into the through-hole of a printed circuit board, both the walls of the U-shaped groove of the press-fitting portion 16 are forced toward each other to reduce its outer size to facilitate the insertion of the press-fitting portion 16 into the through-hole 26. As shown in FIG. 6B of the prior art, applied to the inner surface 19 in the grooves 22 of the contact 40 is a force in the direction shown by an arrow R which acts to bent the connection portion 18 of the contact as shown in broken lines. In contrast herewith, the ramp surface 21 according to the invention serves to resist to that force, thereby preventing the connection portion 18 from being bent.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A C-shaped compliant contact composed of a connection portion to be connected to an electric cable or a connector on the rear side of a printed circuit board, a press-fitting portion to be fixed in a cylindrical through-hole of the printed circuit board by press-fitting, and a contact portion to be in contact with a contact of a mating connector, said press-fitting portion formed to have an inner periphery forming a U-shaped groove in cross-section having flexible sidewalls with an outer periphery having at least one arc portion in cross-section, circles inscribing said inner periphery of said U-shaped groove and circumscribing said sidewall arc portion of said outer periphery being in an eccentric relation, and the thickness of said arc portion in cross-section progressively decreasing on proceeding toward the open end of the U-shaped groove to make said arc portion contacting said through-hole of said printed circuit board longer, wherein said U-shaped groove is formed with a ramp surface located inside said inner periphery adjacent to said connection portion and merging with the bottom of said U-shaped groove and inclined to make said U-shaped groove shallower, and a protrusion projecting from the center of the bottom of said U-shaped groove toward the outside thereof is provided along substantially the full length of said U-shaped groove, the protrusion being configured such that it serves to prevent the separation of the distal ends of the sidewalls of the U-shaped groove from the inner surface of said through-hole without adversely affecting the flexibility of said distal ends.

2. The C-shaped compliant contact as set forth in claim 1, wherein said ramp surface is provided such that grooves on both sides of said protrusion become progressively shallower with a decrease in size of the press-fitting portion adjacent to the connection portion for easy insertion into said through-hole.

3. The C-shaped compliant contact as set forth in claim 1, wherein the merging portion of said ramp surface to said inner periphery of the U-shaped groove, at a location where the walls of the U-shaped groove close together on the side of the connection portion, is located between the top of the protrusion and the outer periphery of the press-fitting portion of the contact.

4. The C-shaped compliant contact as set forth in claim 3, wherein said merging portion of said ramp surface to said inner surface of the U-shaped groove is located at the outer periphery of the press-fitting portion of the contact.

* * * * *

UNITED STATES PATENT AND TRADEMARK OFFICE

CERTIFICATE OF CORRECTION

PATENT NO. : 6,309,228 B2
DATED : October 30, 2001
INVENTOR(S) : Otsuki et al.

It is certified that error appears in the above-identified patent and that said Letters Patent is hereby corrected as shown below:

Column 2,
Line 3, "of" (first occurrence) should read -- on --
Line 3, "0.8 to 0.85" should read -- 0.8 to 0.85 --
Line 5, "has" should read -- is --
Line 35, "described" should read -- as described --
Line 63, "is:" should read -- is --

Column 3,
Line 44, "more" should be deleted

Column 4,
Line 2, "compliant" should read -- compliant contact --
Line 25, "partly" should read -- partial --
Line 28, "partly" should read -- partial --
Line 33, "partly" should read -- partial --
Line 40, "partly" should read -- partial --
Line 44, "partly" should read -- partial --
Line 48, "partly" should read -- partial --

Column 5,
Line 54, "of" (first occurrence) should read -- on --

Column 6,
Line 47, "In more practically," should read -- More practically, --
Line 58, "an inner" should read -- a more inward --
Line 59, "to" should read -- for it to --

UNITED STATES PATENT AND TRADEMARK OFFICE

CERTIFICATE OF CORRECTION

PATENT NO. : 6,309,228 B2
DATED : October 30, 2001
INVENTOR(S) : Otsuki et al.

It is certified that error appears in the above-identified patent and that said Letters Patent is hereby corrected as shown below:

Column 7,
Line 7, "concave" should read -- concavity --
Line 25, "bent" should read -- bend --
Line 27, "herewith," should read -- therewith, --

Signed and Sealed this

Twenty-ninth Day of October, 2002

*Attest:*

*Attesting Officer*

JAMES E. ROGAN
*Director of the United States Patent and Trademark Office*